US007219737B2

(12) United States Patent
Kelly et al.

(10) Patent No.: US 7,219,737 B2
(45) Date of Patent: May 22, 2007

(54) SUBSEA WELLHEAD ARRANGEMENT FOR HYDRAULICALLY PUMPING A WELL

(76) Inventors: Melvin E. Kelly, 2742 Fair Oaks Cir., Odessa, TX (US) 79762; Christopher H. Jenkins, 806 Burgess St., Odessa, TX (US) 79764

( * ) Notice: Subject to any disclaimer, the term of this patent is extended or adjusted under 35 U.S.C. 154(b) by 304 days.

(21) Appl. No.: 10/946,374

(22) Filed: Sep. 21, 2004

(65) Prior Publication Data

US 2006/0060357 A1 Mar. 23, 2006

(51) Int. Cl.
*E21B 29/12* (2006.01)

(52) U.S. Cl. ..... 166/339; 166/351; 166/81.1; 166/68

(58) Field of Classification Search ..... 166/338, 166/339, 340, 341, 344, 351, 360, 362, 378, 166/68, 81.1
See application file for complete search history.

(56) References Cited

U.S. PATENT DOCUMENTS

| | | | | | |
|---|---|---|---|---|---|
| 3,115,933 | A | | 12/1963 | Haeber | |
| 3,168,143 | A | | 2/1965 | Watkins | |
| 3,282,336 | A | * | 11/1966 | Wakefield, Jr. | 166/351 |
| 3,452,815 | A | * | 7/1969 | Watkins | 166/344 |
| 4,003,428 | A | | 1/1977 | Zehren | |
| 4,331,203 | A | | 5/1982 | Kiefer | |
| 4,391,330 | A | | 7/1983 | Kiefer | |
| 4,400,112 | A | | 8/1983 | Castel et al. | |
| 4,405,263 | A | | 9/1983 | Hall | |
| 4,667,986 | A | | 5/1987 | Johnson et al. | |
| 4,673,041 | A | | 6/1987 | Turner et al. | |
| 4,716,970 | A | * | 1/1988 | Henning | 166/372 |
| 4,825,953 | A | | 5/1989 | Wong et al. | |
| 4,993,492 | A | | 2/1991 | Cressey et al. | |
| 5,088,558 | A | | 2/1992 | Mohn | |
| 5,280,766 | A | * | 1/1994 | Mohn | 166/368 |
| 5,374,163 | A | * | 12/1994 | Jaikaran | 417/172 |
| 6,015,013 | A | * | 1/2000 | Edwards et al. | 166/360 |
| 6,328,111 | B1 | * | 12/2001 | Bearden et al. | 166/381 |
| 6,364,633 | B1 | | 4/2002 | Kelly | |
| 6,398,583 | B1 | * | 6/2002 | Zehren | 439/576 |
| 6,609,571 | B2 | | 8/2003 | Nice et al. | |
| 2002/0066572 | A1 | * | 6/2002 | Muth | 166/369 |

OTHER PUBLICATIONS

Intl Search Rpt, Oct. 17, 2006, WIPO.

* cited by examiner

*Primary Examiner*—Thomas A Beach
(74) *Attorney, Agent, or Firm*—Gable Gotwals

(57) ABSTRACT

A subsea well pumping system for installing and retrieving a hydraulically actuated down hole pump employed within the tubing suspended within casing extending from above a seabed, the system having a wellhead assembly affixed to the upper end of the casing for supporting the tubing and including provision for hydraulically communicating with the interior of the casing and the tubing, a remotely controllable main valve affixed to the tubing at its upper end, a tubular pump lubricator affixed at its lower end to the main valve, a removable pump latch sealably closing the pump lubricator at its upper end and having a pump catcher extending downwardly therefrom for removably latching onto the pump and a system for guiding the pump suspended form the pump catcher into the pump lubricator whereby the pump can be moved downwardly in the tubing into a pumping position by fluid injected into the tubing and can be moved upwardly in the tubing into a retrievable position for grasping by the pump catcher by fluid injected into the casing.

5 Claims, 4 Drawing Sheets

SUBSEA WELLHEAD ARRANGEMENT FOR HYDRAULICALLY PUMPING A WELL

BACKGROUND OF THE INVENTION

The invention disclosed herein is concerned with underwater pump installations and more particularly with systems, methods and apparatus for installing a hydraulically actuated down hole pump employed in tubing suspended within casing extending from above a sea bed but below the surface of an ocean or other body of water.

The increasing demand for oil and gas has greatly stimulated the drilling and operation of subsea wells. Substantial prior art has been developed with respect to subsea wells and with respect to installing and retrieving hydraulically actuated down hole pumps. For examples of such prior art reference may be had to the following:

| Patent Number | Inventor | Issue Date |
|---|---|---|
| 3,115,933 | Haeber | Dec. 31, 1963 |
| 3,168,143 | Watkins | Feb. 2, 1965 |
| 3,282,336 | Wakefield | Nov. 1, 1966 |
| 3,452,815 | Watkins | Jul. 1, 1969 |
| 4,003,428 | Zehren | Jan. 18, 1977 |
| 4,331,203 | Kiefer | May 25, 1982 |
| 4,391,330 | Kiefer | Jul. 5, 1983 |
| 4,400,112 | Castel, et al. | Aug. 23, 1983 |
| 4,405,263 | Hall | Sep. 20, 1983 |
| 4,667,986 | Johnson, et al. | May 26, 1987 |
| 4,673,041 | Turner, et al. | Jun. 16, 1987 |
| 4,825,953 | Wong, et al. | May 2, 1989 |
| 4,993,492 | Cressey, et al. | Feb. 19, 1991 |
| 5,088,558 | Mohn | Feb. 18, 1992 |
| 6,609,571 | Nice, et al. | Aug. 26, 2003 |

In general, the techniques revealed in these previously issued patents suffer from one or more of the following deficiencies: complexity, high cost, reliability, inefficiency, exposure of the pipe assembly to damages, insecure and inadequate mounting and sealing of pump assemblies in the wellhead, exposure of installation apparatus and systems to seawater and failure to adequately protect the environment. The invention disclosed herein overcomes many of these deficiencies.

BRIEF SUMMARY OF THE INVENTION

The invention herein provides a subsea well pumping system for installing and retrieving a hydraullically actuated down hole pump. The system includes the use of tubing suspended within casing in a well bore hole, the casing extending from above a seabed.

The system includes a wellhead assembly affixed to the upper end of the casing for supporting the tubing. Further, the wellhead assembly include the provision for hydraulically communicating with the interior of the casing and the tubing.

A remotely controllable main valve is affixed to the tubing at its upper end. A tubular pump lubricator is affixed to the main valve. A removable pump latch sealably closes the pump lubricator at its upper end and has a pump catcher extending downwardly from it. The function of the pump catcher is for removably latching onto a hydraulically actuated down hole pump.

As one example of the application of the invention a system is provided for guiding the hydraulically actuated down hole pump suspended from the pump catcher into a pump lubricator. From the pump lubricator, the down hole pump can be moved into the tubing and thereby into a pumping position by fluid injected into the tubing. The pump can be moved upwardly in the tubing into a retrievable position for grasping by the pump catcher by fluid injected into the casing. That is, the hydraulically actuated down hole pump may be moved into a lower position within the bottom of the tubing or to an upper position for retrieval both by means of hydraulic fluid pressure.

The subsea well pumping system of this invention includes, in one embodiment, a wire line guide assembly including at least one wire line secured at its lower end in fixed relationship to the well head and a wire line installation and retrieval assembly for guiding the hydraulically actuated pump into the pump lubricator. In another application of the invention, the use of guide wires are not required and instead divers and remote operated vehicles (ROV's) can be employed to install and retrieve the pump.

A better and more complete understanding of the invention will be obtained from the following detailed description of the preferred embodiment taken in conjunction with the attached claims and drawings.

DETAILED DESCRIPTION OF THE PREFERRED EMBODIMENTS

Figure 1:
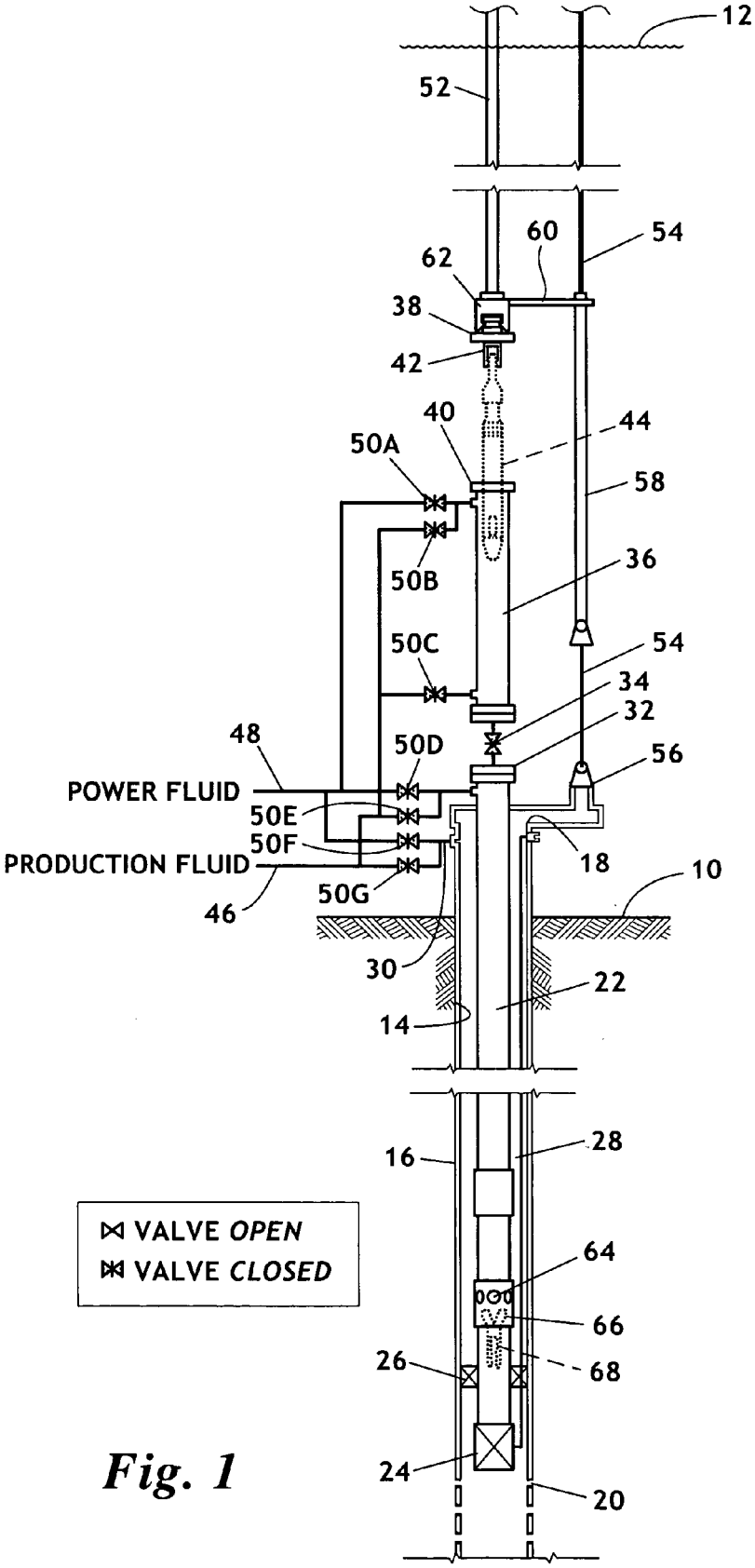
FIG. 1 provides is an elevational diagrammatic view of a subsea well having casing suspended therein and, received within the casing tubing, that extends from a subsea surface down to a producing formation. A hydraulically actuated down hole pump shown in dotted outline as the pump is being positioned within a pump lubricator.

It is understood that the invention disclosed herein is capable of being practiced using different systems and types of apparatus and that the description herein is to exemplify one embodiment. The invention is not limited to the illustrated embodiments disclosed herein but is to be limited only by the scope of the claim or claims including the full range of equivalency to which each element or step thereof is entitled.

In illustrating and describing the invention, numerals are used to indicate elements as follows:

10 sea floor
12 sea surface
14 bore hole
16 casing
18 upper end
20 perforations
22 tubing string
24 safety valve
26 packer
28 annular fluid channel
30 connecting pipe
32 upper end
34 main valve
36 pump lubricator
38 pump latch
40 upper end
42 pump catcher
44 down hole pump
46 production flow line
48 power fluid flow line
50A–50G flow control valves
52 guideline wire
54 guide wire
56 anchor
58 tubular guide
60 extension
62 attachment member
64 ports
66 bottom hole assembly
68 standing valve The figures herein are diagrammatic views of a subsea well pumping system shown in a subsea environment, the sea floor being indicated by the numeral 10 and the surface of the sea by the numeral 12. The pumping system may include the use of a floating platform (not shown) positioned on sea surface 12 or the system may be employed with a fixed platform (not shown) having legs that extend down to rest upon the sea floor 10.

The well shown in the drawings is created by first drilling a bore hole 14 that extends from the sea floor 10 downwardly in the earth to a producing oil and/or gas formation. Positioned within bore hole 14 is a metal casing 16 that has an upper end 18 above the sea floor 10. Adjacent a lower end of casing 18 perforations 20 are formed to permit crude oil to flow into the lower portion of the casing so that it can be pumped to the earth's surface.

Positioned within casing 16 is a tubing string 22 that extends down to adjacent the casing lower end to the area in communication with perforations 20. Affixed to the lower end of tubing 20 is a subsurface safety valve 24. Above valve 24 a packer 26 is positioned to sealably close off the upper interior portion of casing 16. In this manner there is provided a closed annular fluid channel 28 within casing 16 above the packer and exterior to tubing 22. A connecting pipe 30 communicates with the closed annular fluid channel 28.

The upper end 32 of tubing string 22 communicates with a main valve 34, shown diagrammatically. When fully opened, main valve 34 provides a passageway therethrough at least substantially equal to the interior diameter of tubing 22. Affixed at an upper end of main valve 34 is a pump lubricator 36. A pump latch 38 removably closes the upper end 40 (See FIG. 1) of pump lubricator 36. Secured to pump latch 38 is a pump catcher 42 that has facilities for removably latching onto a hydraulically actuated down hole pump 44, shown in dotted outline.

Connected to the well as shown in FIG. 1 is a production flow line 46 and a power fluid flow line 48. Flow lines 46 and 48 extend to the earth's surface where they are connected to equipment (not shown) for receiving crude oil production from the well and for introduction of power fluid to the well.

In addition to main valve 48, operation of the well utilizes seven flow control valves identified by the numerals 50A–50G. Flow control valves 50A, 50D and 50F are connected to power fluid flow line 48. Valves 50B, 50C, 50E and 50G are connected to production flow line 46. Each of flow control valves 50A–50G are remotely controllable from the earth's surface. Control cables that extend from the earth's surface to valves 50A–50G are not shown.

Down hole pump 44 can be placed into or removed from the interior of pump lubricator 36 in a variety of ways such as by a wire line, by guide wires, by a remote operated vehicle or by diver assistance. In the drawings, a method of removable and installation of pump 44 is shown by use of a guide line wire 52 and with the use of a guide wire 54, as one example of a method of practicing the invention. In the illustrated arrangement, the guide wire 54 is affixed at its lower end to an anchor 56 that is secured to the upper end 18 of casing 16. Slideably received on guide wire 54 is a tubular guide 58 having an extension 60 by which pump latch 38 is guided. As above stated, this procedure for guiding down hole pump 44 into and out of pump lubricator 36 is by way of example only as it can be done with the use of a remote operated vehicle or by a diver.

FIG. 1 shows the system as used for installing a down hole pump 44. Pump 44 may be a new pump or it may be a pump as initially used in the well that has been removed and repaired. In the arrangement of FIG. 1, all the valves 34 and 50A–50G are closed. Pump latch 38 is maneuvered so that pump 44 extending downward from pump catcher 42 is positioned to be received into the upper open end 40 of pump lubricator 36.

Figure 2:
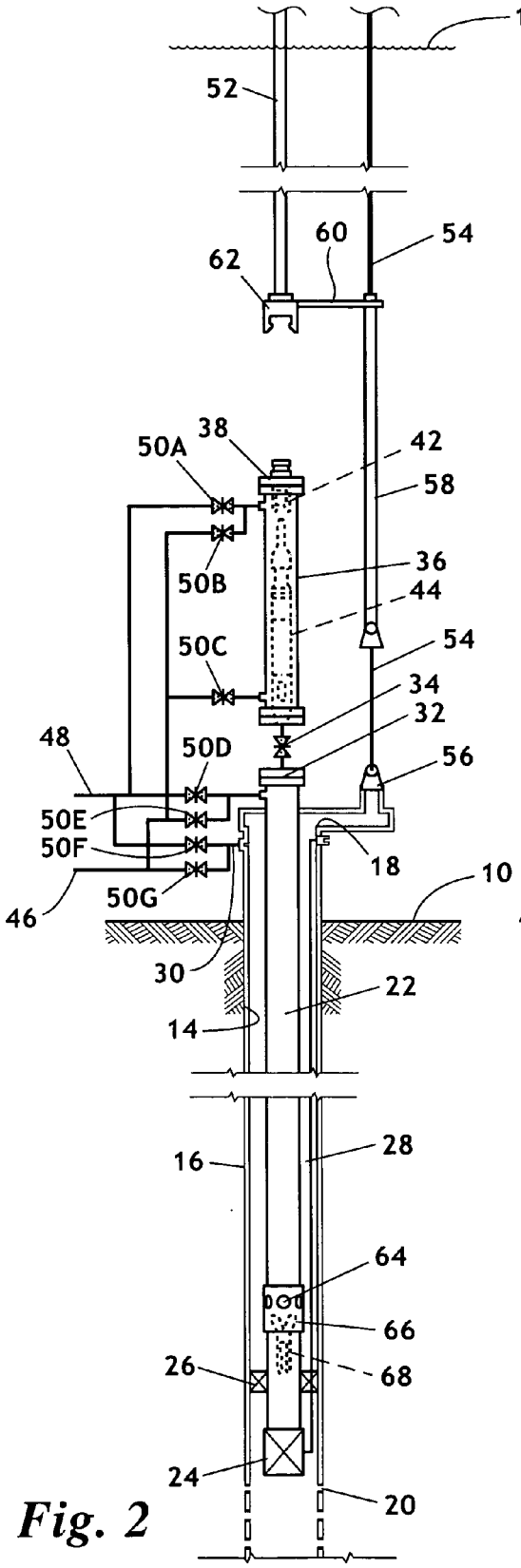
FIG. 2 is an elevational diagrammatic view as FIG. 1 showing the hydraulically actuated down hole pump fully received within the pump lubricator and a pump latch in sealed position closing the top of the lubricator.

After pump 44 is placed fully within lubricator 36 as shown in FIG. 2 pump latch 38 is secured in position, and pump 44 is released from catcher 42.

Figure 3:
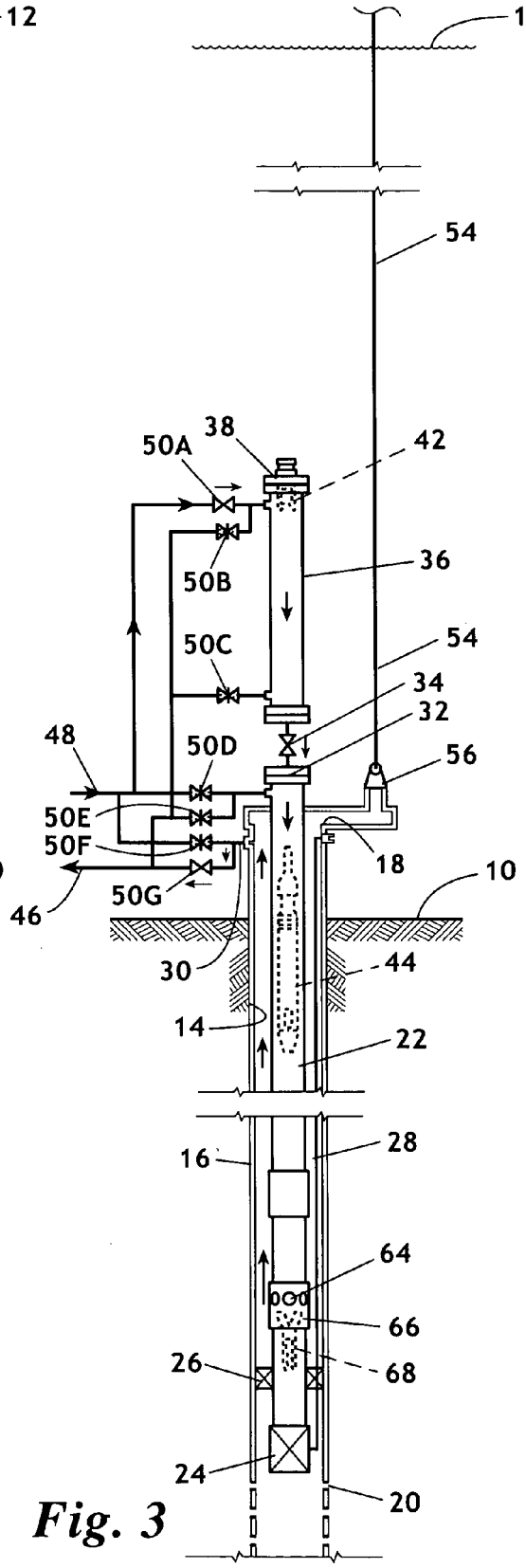
FIG. 3 is an elevational view as in FIGS. 1 and 2 showing the hydraulically actuated down hole pump having passed through a main valve and into the tubing as the pump is being moved downwardly into an operating position by fluid flow.

Thereafter, main valve 34 is opened permitting pump 44 to pass downwardly therethrough and into tubing 22 as seen in FIG. 3. Pump 44 is circulated downwardly within tubing 22 by hydraulic force of power fluid from flow line 48 flowing through opened flow control valve 50A. That moves power fluid into lubricator 36 and downwardly through tubing 22. This downward flow of power fluid through tubing 22 passes into annular fluid channel 28 through ports 64 in a bottom hole assembly 66. The power fluid passing upwardly in annular fluid channel 28 and into production flow line 46 through open flow control valve 50G.

Figure 4:
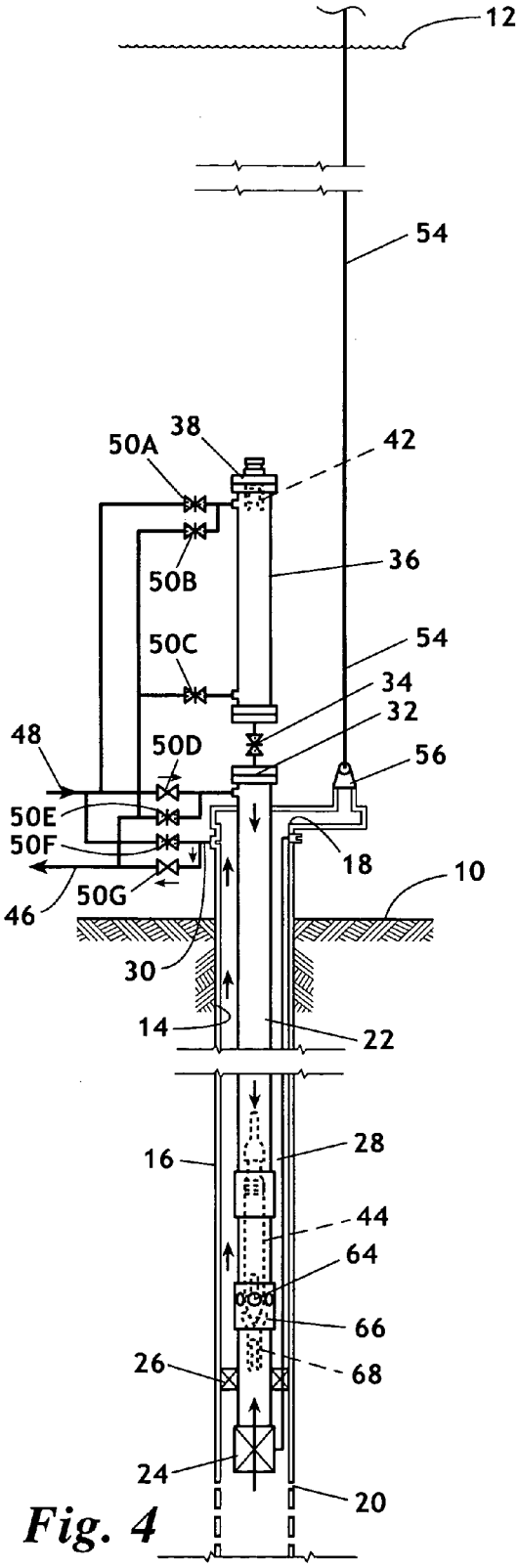
FIG. 4 shows the hydraulically actuated down hole pump in operating position as received by a standing valve. In this Figure, crude oil is being pumped from a producing formation.

Flow in the manner illustrated in FIG. 3 continues until pump 44 is seated in bottom hole assembly 66 as shown in FIG. 4. Bottom hole assembly 66 includes a standing valve 68. The function of standing valve 68 is, after pump 64 has been seated therein, to block downward fluid flow within tubing 22 but to permit flow into the bottom end of the tubing through safety valve 24.

FIG. 4 shows down hole pump 44 in a seated position and ready for use to pump fluid from within casing 16 below packer 26 to the earth's surface. This is accomplished as illustrated in FIG. 4 by pumping power fluid downwardly through power fluid flow line 48, through open flow control valve 50D and into the upper end of tubing 22. The power fluid actuates hydraulically operated bottom hole pump 44 to lift fluid through standing valve 68 and force production fluid from below packer 26 through ports 64 into the annular fluid channel 28 within the casing 14 to the earth's surface. The produced fluid flows upwardly in annular fluid channel 28 and flows through open flow control valve 50G into production flow line 46. Power fluid passing through open flow control valve 50D is supplied by pump pressure from the earth's surface (not shown). As shown in FIG. 4, production fluid is pumped to the earth's surface by down hole pump 44 hydraulically actuated by power fluid moving downwardly within tubing 22 and combined power fluid and production fluid flowing upwardly through annular fluid channel 28 as shown by the arrows. Production fluid moves upwardly through safety valve 24 and is pumped out through port 64 by pump 44.

The well system remains in the condition as shown in FIG. 4 as long as production fluid is pumped from the subterranean formation by the action of power fluid injected through power fluid flow line 48, the power fluid returning to the earth's surface commingled with production fluid through production flow line 46.

Figure 5:
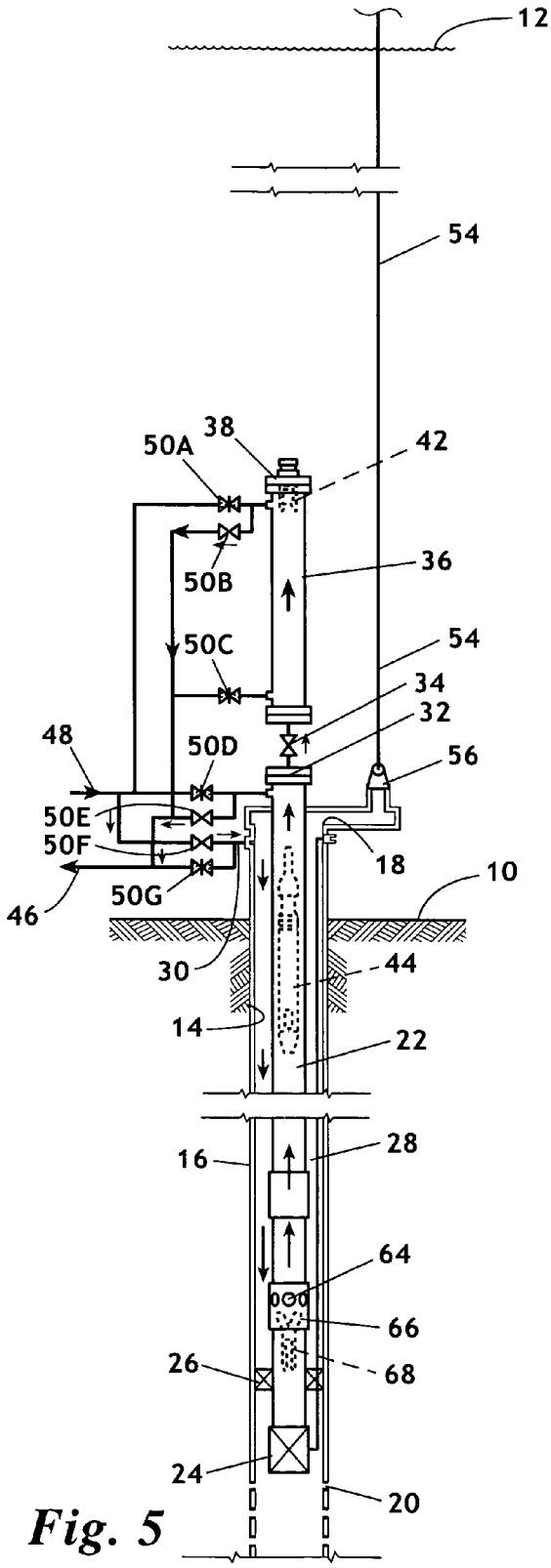
FIG. 5 shows the hydraulically actuated down hole pump in the process of being retrieved from its operating position at the bottom of the tubing. The pump is shown as it is being moved in an upward direction within the tubing, by hydraulic action of fluid flow.
Figure 6:
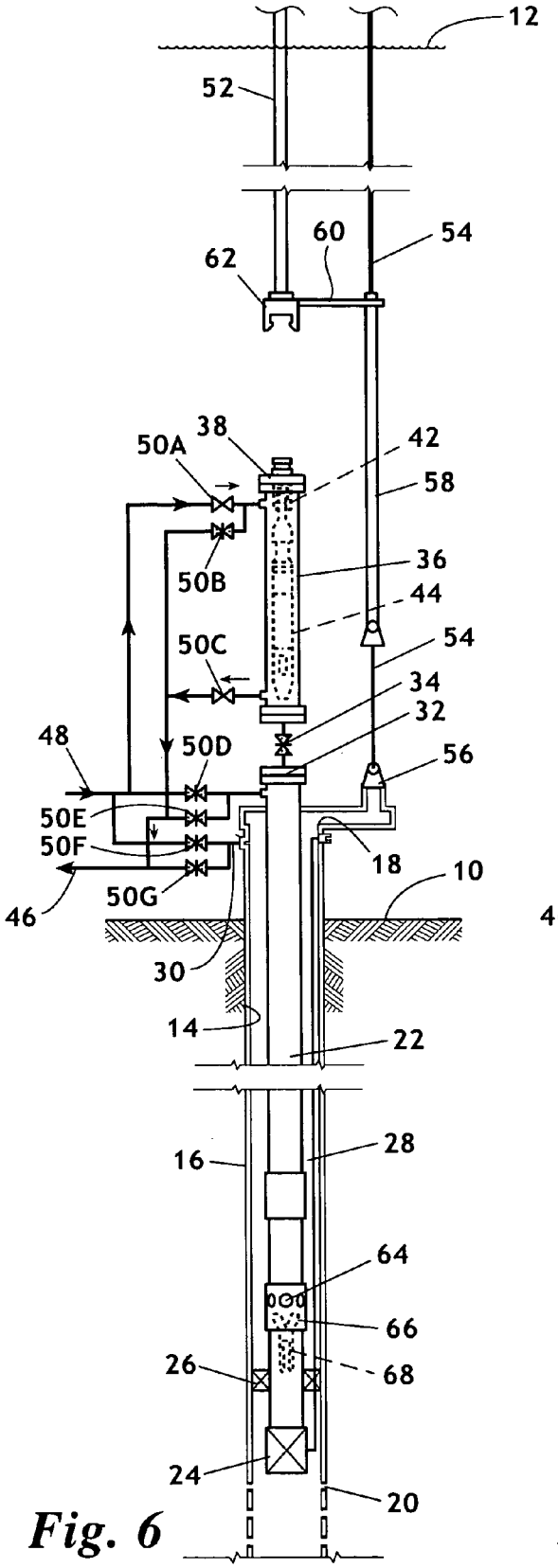
FIG. 6 shows the hydraulically actuated down hole pump having moved through the main valve and received within the pump lubricator.
Figure 7:
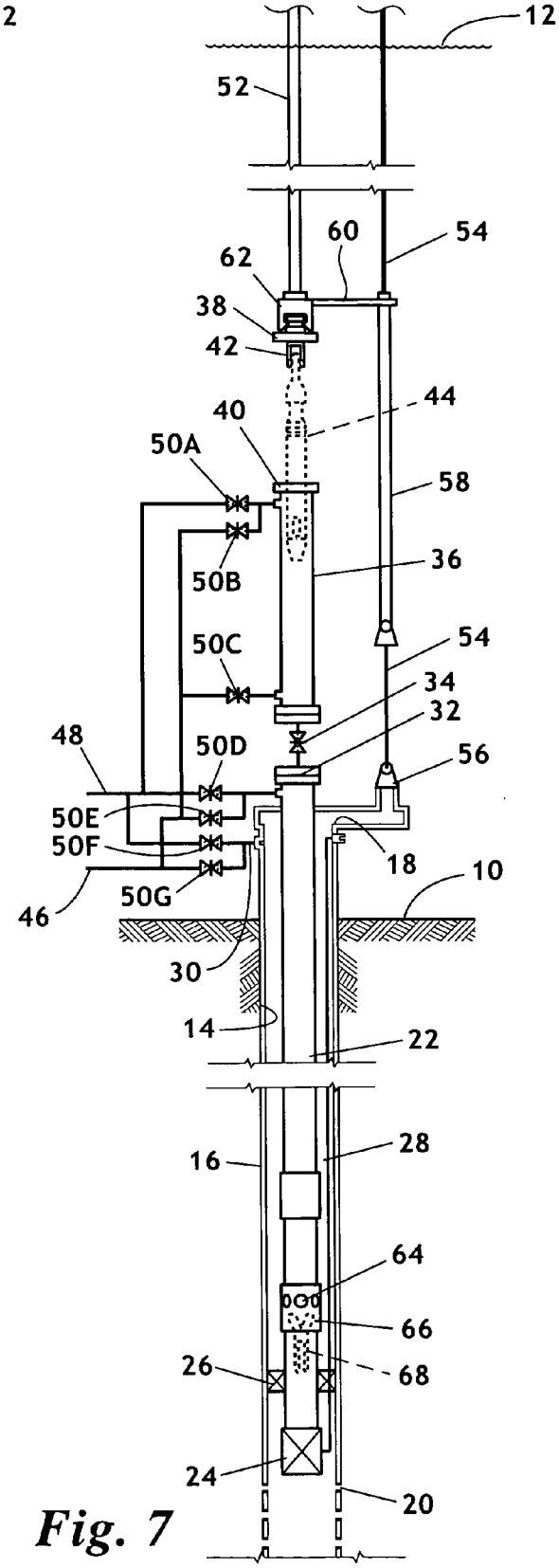
FIG. 7 shows the hydraulically actuated down hole pump as it is grasped by a pump latch that is affixed to the end of a wire line showing one system for retrieving the pump by which it can be moved to a location at the sea surface where it can be repaired or replaced.

When pump 44 must be repaired or replaced, steps illustrated in FIGS. 5–7 are followed. As shown in FIG. 5, master valve 34 is opened, flow control valves 50A, 50C, 50D, and 50G are closed and flow control valves 50B, 50E and 50D are opened so that power fluid from flow line 48 flows in a reversed direction—that is, flows downwardly through annular fluid channel 28 through ports 64 and upwardly within tubing 22, all as shown by the arrows. Flow upwardly in tubing 22 forces pump 44 in the upward direction. With main valve 34 open, pump 34 passes upwardly through the open valve and into pump lubricator 36.

When pump 44 is safely within pump lubricator 36, main valve 34 is closed as shown in FIG. 6. In like manner, flow control valves 50B, 50D, 50E, 50F, and 50G are closed while flow control valves 50A and 50C are open. This permits fluid to be circulated in the direction shown by the arrows. Fluid from power fluid flow line 48 moves into an upper end of pump lubricator 36 and downwardly past pump 44, the fluid passing out of lubricator 36 through open flow control valve 50C and back to the earth's surface through production flow line 46. In this way, pump 44 can be completely cleaned of crude oil since the fluid flowing past it in the condition as shown in FIG. 6 may be water having a detergent or soap therein or other cleaning fluid by which the pump is rinsed clean. After pump 36 has been cleaned by the fluid flow paths as shown in FIG. 6, attachment member 62 may be lowered to grasp and remove pump latch 38 having pump 44 attached to it. The pump 44 may then be withdrawn by means of guide wires 52 and 54 up to the earth's surface where the pump can be replaced or repaired. When a new or repaired pump is to be installed, the sequence of FIGS. 1–4 are repeated to reinstall the pump where it can be hydraulically actuated to extract crude oil from the producing formation.

FIGS. 1 through 7 illustrate the system of this invention in which down hole pump 44 is installed or removed by use of guide wires 52 and 54. This is by way of example only as the pump may be removed from or placed in pump lubricator by divers or by use of remotely operated vehicles.

The system of the invention provides a means of installing and removing a hydraulically actuated down hole pump from a subsea location in a manner to substantially reduce contamination of the environment.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claims, including the full range of equivalency to which each element thereof is entitled.

What is claimed is:

1. A subsea well pumping system for installing and retrieving a hydraulically actuated down hole pump employed within tubing suspended within casing extending from above a seabed, the system including:

a wellhead assembly affixed to the upper end of the casing for supporting the tubing and including provision for hydraulically communicating with the interior of the casing and the tubing;

a remotely controllable main valve affixed to the tubing at its upper end;

a tubular pump lubricator affixed at its lower end to said main valve;

a removable pump latch sealably closing said pump lubricator at its upper end and having a pump catcher extending downwardly therefrom for removably latching onto the hydraulically actuated down hole pump; and a system for guiding the hydraulically actuated down hole pump suspended from said pump catcher into said pump lubricator whereby the down hole pump can be moved downwardly in the tubing into a pumping position by fluid injected into the tubing and can be moved upwardly in the tubing into a retrievable position for grasping by said pump catcher by fluid injected into said casing.

2. A subsea well pumping system according to the claim 1 including:

a remotely controllable manifold valve system interrelating the flow into and out of the tubing, casing and said pump lubricator.

3. A subsea well pumping system according to the claim 1 including:

a standing valve supported within a lower portion of said tubing for sealably receiving the down hole pump when in said pumping position.

4. A subsea well pumping system according to claim 1 including:

a wire line guide assembly including at least one wire line secured at its lower end in fixed relation to said wellhead; and a wire line installation and retrieval assembly forming said system for guiding the hydraulically activated down hole pump into said pump lubricator.

5. For use in a well pumping system employing an unsupported hydraulically actuated down hole pump and tubing suspended in casing by a wellhead, a pump insertion and removal system comprising:

a tubular pump lubricator having open upper and lower ends, having sidewall fluid inlets adjacent said upper and lower ends and configured to fully receive the unsupported hydraulically actuated down hole pump therein; and a main valve secured to and for sealably closing said lower end of said pump lubricator when in a closed condition and for permitting said unsupported down hole pump to pass therethrough when open permitting said pump lubricator to be flushed.

* * * * *